US005873446A

United States Patent [19]

Wei

[11] Patent Number: 5,873,446

[45] Date of Patent: Feb. 23, 1999

[54] COIN BOX ASSEMBLY

[75] Inventor: Ming Shan Wei, Kaohsiung, Taiwan

[73] Assignee: Paokai Electronic Enterprise Co., Ltd., Kaohsiung, Taiwan

[21] Appl. No.: 869,972

[22] Filed: Jun. 5, 1997

[30] Foreign Application Priority Data

Nov. 29, 1996 [TW] Taiwan ..... 85218545

[51] Int. Cl.[6] ..... G07F 9/06

[52] U.S. Cl. ..... 194/350; 232/16

[58] Field of Search ..... 194/350; 232/15, 232/16

[56] References Cited

U.S. PATENT DOCUMENTS

| | | | |
|---|---|---|---|
| 3,926,366 | 12/1975 | Sciortino | 232/15 |
| 5,224,579 | 7/1993 | Brown | 194/350 |
| 5,619,932 | 4/1997 | Efland et al. | 194/350 X |

FOREIGN PATENT DOCUMENTS

| | | | |
|---|---|---|---|
| 561579 | 9/1993 | European Pat. Off. | 194/350 |

*Primary Examiner*—F. J. Bartuska
*Attorney, Agent, or Firm*—Bacon & Thomas, PLLC

[57] ABSTRACT

A coin box assembly includes a main housing and a coin box removably received in the main housing. The main housing includes a pair of rails to guide the coin box to a position completely received in the main housing. The coin box includes an upper lid assembly which has a fixed plate and a movable door plate biased toward the fixed plate such that an upper opening of the coin box is in a normally open position for receiving coins. The main housing further includes a coin access defined in an upper plate thereof and in alignment with the upper opening of the coin box when the coin box is completely received in the main housing. When removing the coin box from the main housing, the stop of the movable door plate is moved across an electromagnetic valve mounted on the coin box such that the door plate is moved away from the fixed plate and thus blocks the upper opening of the coin box. The stop of the door plate is securely engaged with the electromagnetic valve after the stop has been moved across the electromagnetic valve to still block the upper opening of the coin box.

2 Claims, 5 Drawing Sheets

COIN BOX ASSEMBLY

BACKGROUND OF THE INVENTION

1. Field of the Invention

The present invention relates to a burglar-proof coin box assembly.

2. Description of the Related Art

Coin boxes are widely used in pay phones, slot machines, etc., and a long-existing problem thereof is that the coin boxes can be accessed by unauthorized persons. The present invention is intended to provide a burglar-proof coin box assembly to solve this problem.

SUMMARY OF THE INVENTION

A coin box assembly in accordance with the present invention comprises a coin box comprising an upper opening defined in an upper side thereof and an upper lid assembly. The upper lid assembly includes a fixed plate, a movable door plate attached to the fixed plate, and means for biasing the door plate toward the fixed plate such that the upper opening of the coin box is in a normally open position for receiving coins. The coin box further includes a pair of first horizontal grooves respectively defined in two lateral inner walls thereof, and the door plate includes two lateral edges respectively, slidably received in the first horizontal grooves. The movable plate further includes an actuating block mounted to a first end of an upper side thereof and a stop mounted to a second end of the underside thereof. The coin box further includes a second horizontal groove defined in each of two lateral outer walls thereof.

A main housing is provided for receiving the coin box. The main housing comprises a first end adjacent to the fixed plate and a second end distal to the fixed plate. An opening is defined in the first end of the main housing through which the coin box is passable. A pair of rails are mounted in the second end of the main housing at a level higher than a bottom plate of the main housing for respectively engaging with the second horizontal grooves of the coin box. An inclined plate is provided in the main housing in front of the rails for lifting the coin box to engage with the rails so as to guide the coin box to a position completely received in the main housing. The main housing further includes a coin access defined in an upper plate thereof and in alignment with the upper opening of the coin box when the coin box is completely received in the main housing. A pivotal plate is pivotally mounted below the upper plate of the main housing. The pivotal plate is only rotatable in a direction which allows insertion of the coin box and to prevent removal of the coin box from the main housing when the actuating block of the coin box contacts with the pivotal plate.

A locking means is provided for securing the coin box in position when the coin box is completely received in the main housing, and an electromagnetic valve is mounted to the coin box. When removing the coin box from the main housing, the stop of the movable door plate is moved across the electromagnetic valve such that the door plate is moved away from the fixed plate and thus blocks the upper opening of the coin box. In addition, the stop of the door plate is securely engaged with the electromagnetic valve after the stop has been moved across the electromagnetic valve to still block the upper opening of the coin box.

The coin box assembly further includes a means for activating the electromagnetic valve to disengage from the stop of the door plate so as to urge the door plate to move away from the fixed plate, thereby revealing the upper opening of the main housing again. The activating means includes a code input device, a control means electrically connected to the code input device, and a code identifying device, the control means is connected to the electromagnetic valve and activates the electromagnetic valve to disengage from the stop of the movable plate when a proper code is inputted via the code input device.

The coin box assembly may further comprise a means for counting a quantity of coins which have passed through the coin access.

Other objects, advantages, and novel features of the invention will become more apparent from the following detailed description when taken in conjunction with the accompanying drawings.

DESCRIPTION OF THE PREFERRED EMBODIMENT

Figure 1:
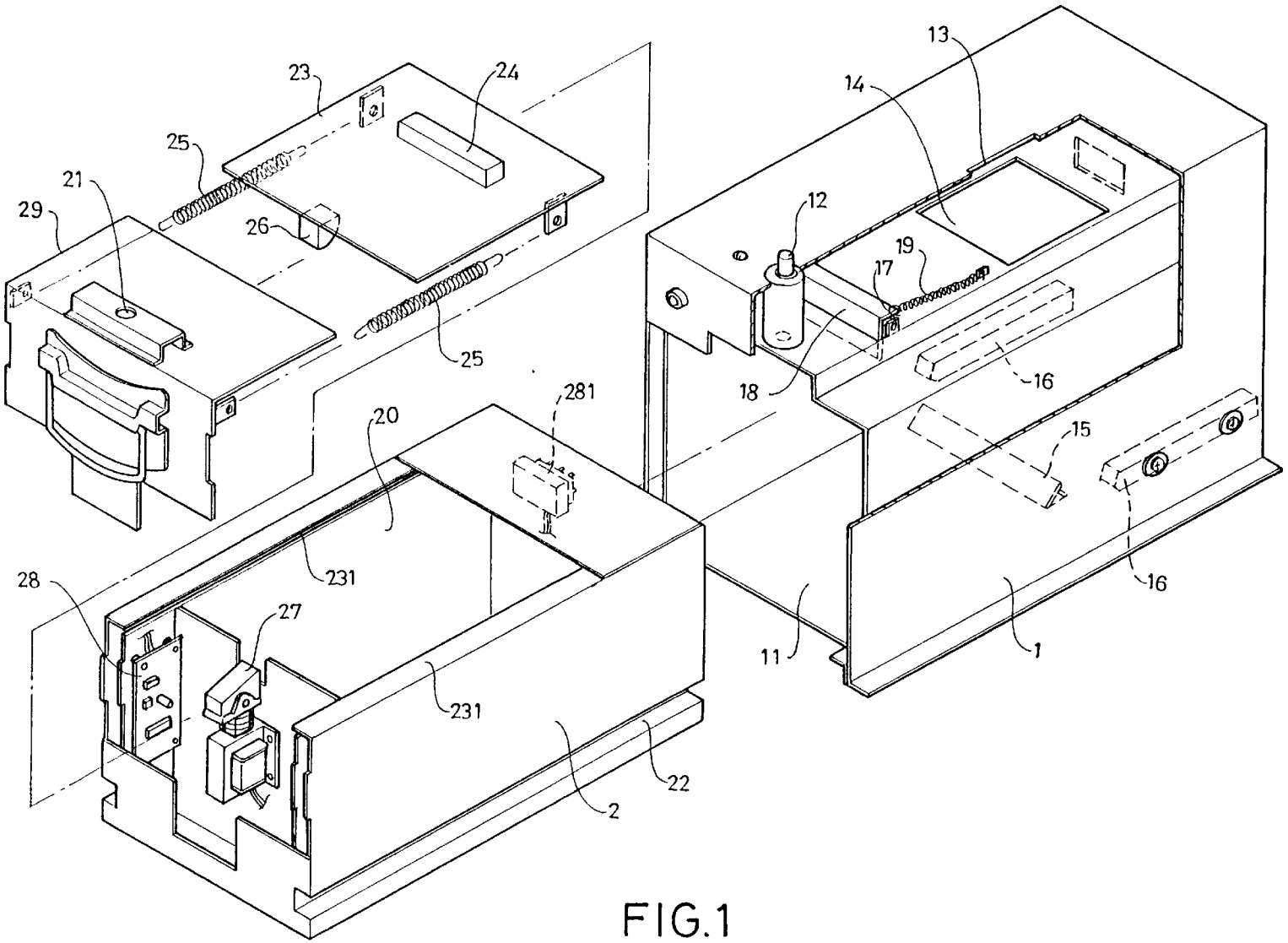
FIG. 1 is an exploded perspective view of a coin box assembly in accordance with the present invention.
Figure 3:
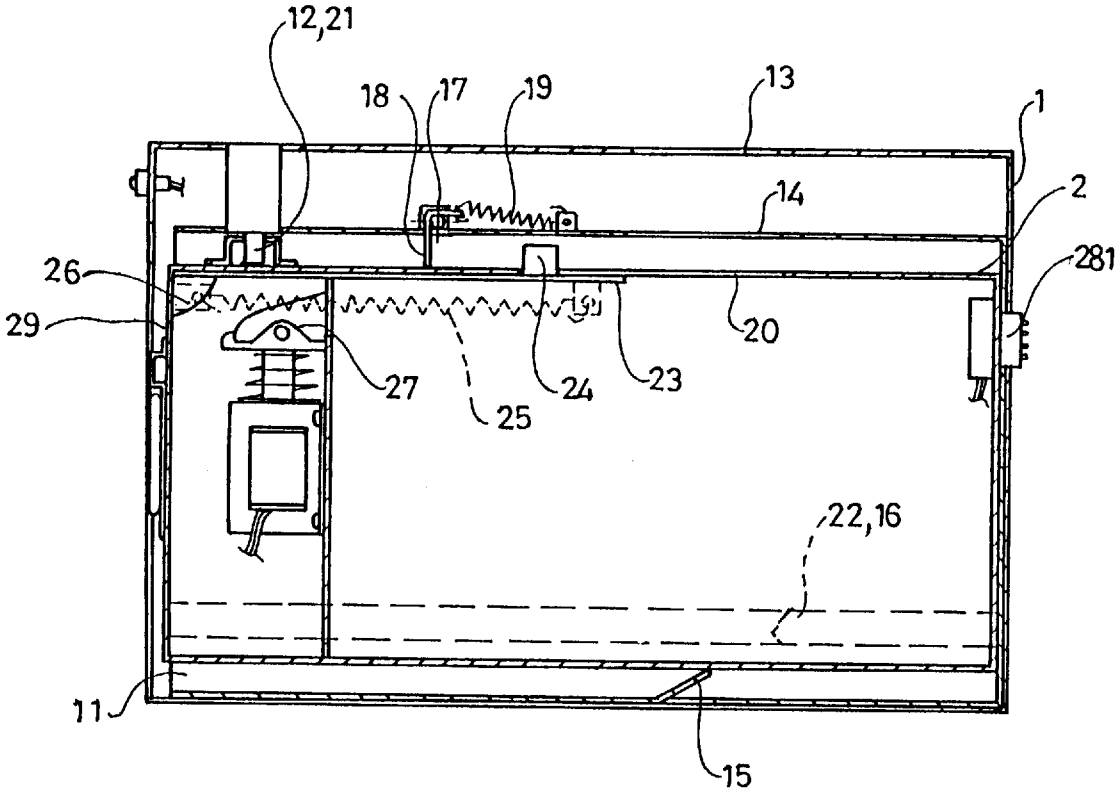
FIG. 3 is a sectional view similar to FIG. 2, in which the coin box is in a secured position.

Referring to FIGS. 1 and 3, a coin box assembly in accordance with the present invention generally includes a main housing 1 comprising an opening 11 defined in a first end thereof through which a coin box 2 passes. The main housing 1 further comprises a pair of rails 16 respectively mounted on two inner lateral walls thereof. The rails 16 are located adjacent to a second end of the main housing 1 opposite to the first end, and the rails 16 are mounted at a level higher than a bottom plate (not labeled) of the main housing 1. In addition, an inclined plate 15 is provided in the main housing 1 in front of the rails 16, which will be described later. A coin access 13 is defined in an upper plate (not labeled) of the main housing 1, and a detecting means 14 (e.g., an electric eye) is provided adjacent to the coin access 13 to detect whether a coin passes through the coin access 13, and a quantity of the coins which have passed through the coin access 13 can be counted by a counter (not shown). In addition, a pivotal plate 18 is pivotally mounted below the upper plate of the main housing 1 by pivoting member 17, in which the pivotal plate 18 is only rotatable in a direction which allows insertion of the coin box 2 when the coin box 2 contacts with the pivotal plate 18. A spring 19 is provided to return the pivotal plate 18 back to its initial position shown in FIG. 3.

The coin box 2 comprises an upper opening 20 defined in an upper side thereof and an upper lid assembly for covering the upper opening 20. The upper lid assembly includes a fixed plate 29 and a movable door plate 23 attached to the fixed plate 29 by springs 25 which bias the door plate 23, toward the fixed plate 29 such that the upper opening 20 of the coin box 2 in a normally open position for receiving coins from the coin access 13. The coin box 2 further includes a pair of horizontal guiding grooves 231 respectively defined in two lateral inner sides thereof for receiving two lateral edges of the movable door plate 23, thereby guiding the movable door plate 23. Mounted on top of the fixed plate 29 is a hole 21 which may engage with a locking means 12 on the main housing 1 when the coin box 2 is completely received in the main housing 1 to secure the coin box 2 in position, such that the coin box 2 cannot be removed from the main housing 1 without a proper key for the lock means 12.

An actuating block 24 is mounted to a first end (which is distal to the fixed plate 29) of an upper side of the movable plate 23 which will be described later. A stop 26 is mounted to a second end (which is adjacent to the fixed plate 29) of the underside of the movable plate 23 and includes an arcuate surface defined in an underside thereof. The coin box 2 further includes a horizontal groove 22 defined in each of two lateral sides thereof.

Figure 2:
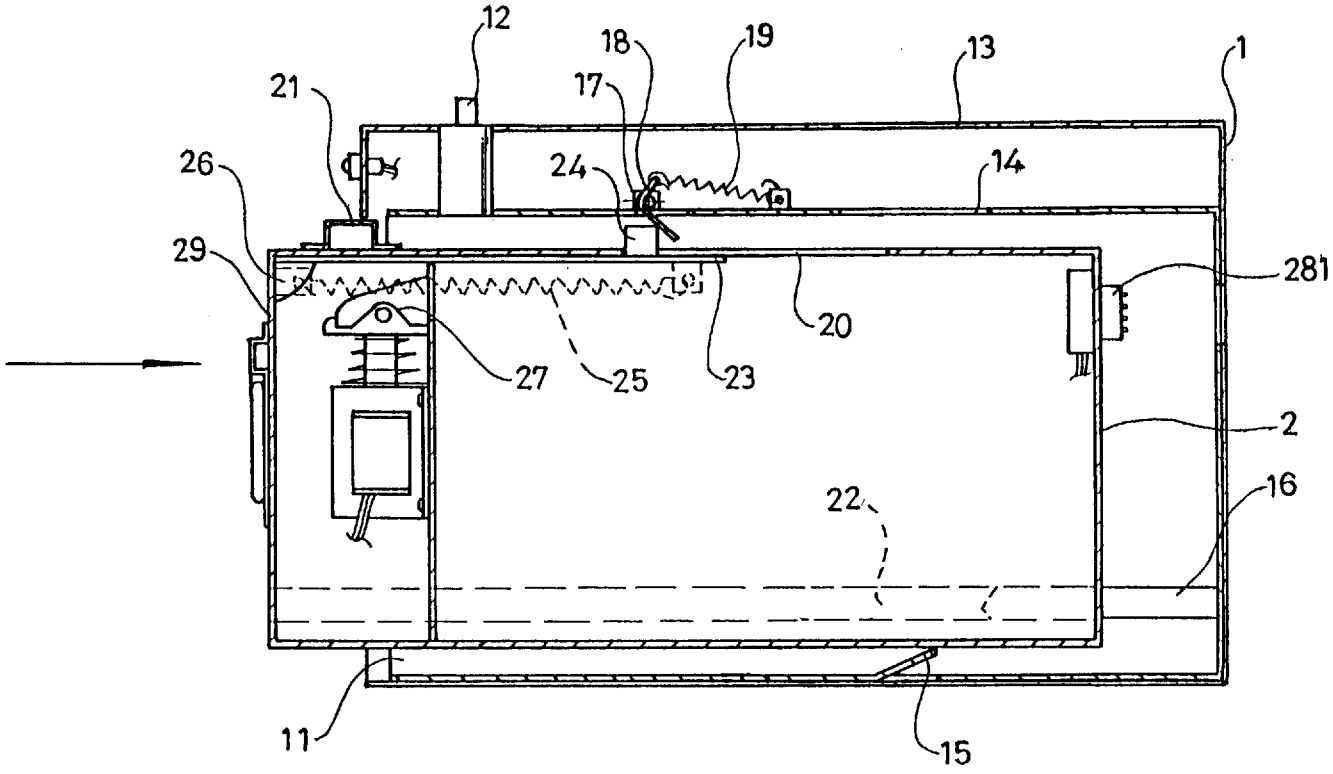
FIG. 2 is a sectional view illustrating insertion of a coin box.

Referring to FIG. 2, when the coin box 2 is inserted into the main housing 1, a bottom of the coin box 2 is elevated under the guidance of the inclined plate 15 such that the horizontal grooves 22 of the coin box 2 respectively receive and thus guided by the rails 16 in the main housing 1. The actuating block 24 is lifted to a higher level so as to urge the pivotal plate 18 to pivot inwardly and thus allows further insertion of the coin box 2 into the main housing 1. When the coin box 2 is completely received in the main housing 1, as shown in FIG. 3, the access 13 aligns with the upper opening 20 of the coin box 2, and the user may press the lock means 12 so as to engage with the hole 21 defined in the fixed plate 29. It is appreciated that other types of lock means can be used to achieve the same function.

Figure 4:
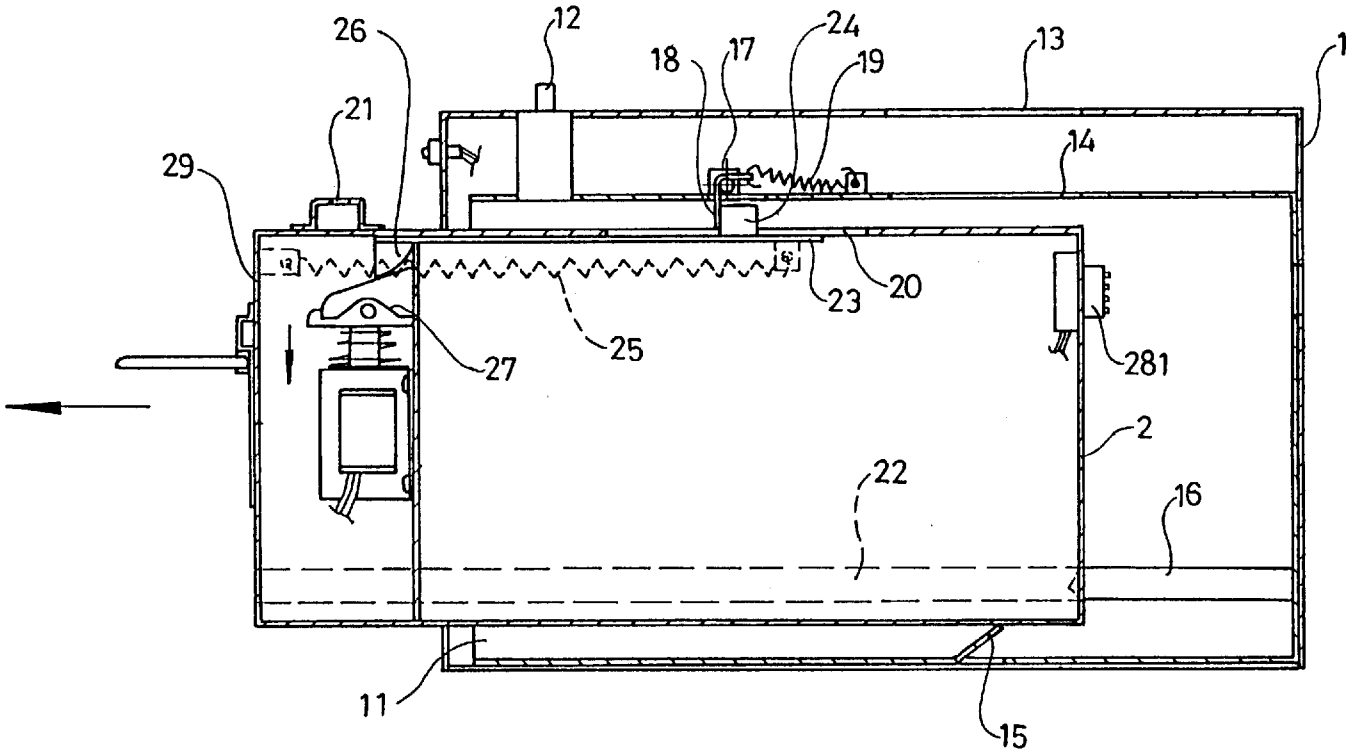
FIG. 4 is a sectional view similar to FIG. 2, illustrating removal of the coin box.
Figure 5:
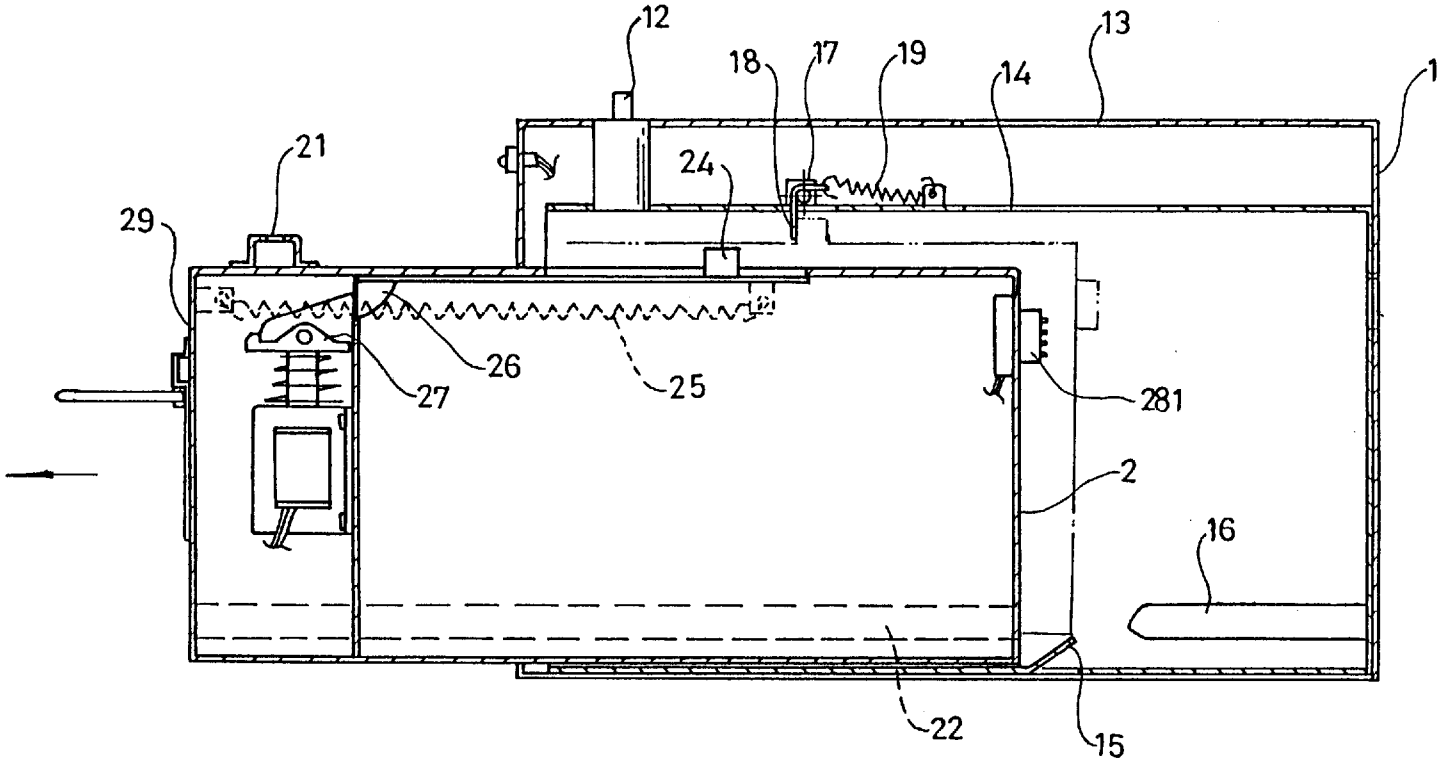
FIG. 5 is a sectional view similar to FIG. 4, in which the coin box is in a position ready for removal.

When removing the coin box 2 from the main housing 1 is required, referring to FIG. 4, the user may firstly use a proper key to unlock the lock means 12, and then pull the coin box 2 outwardly until the actuating block 24 is stopped by the pivotal plate 18 which cannot be pivoted in a reverse direction. At this moment, the movable door plate 23 is moved away from the fixed plate 29 to close the upper opening 20 such that the stop 26 on the movable door plate 23 moves rightwardy (i.e., inwardly) across an electromagnetic valve 27 mounted in the coin box 2, as shown in FIG. 5 (the arcuate surface of the stop 26 allows such movement). The movable door plate 23 now completely blocks the opening 20, and the movable door plate 23 is stopped by the electromagnetic valve 27 and thus is retained in a closed position. Yet, the grooves 22 of the coin box 2 now disengage from the rails 16 such that the coin box 2 can move downwardly. Accordingly, the actuating block 24 moves downwardly and thus disengages from the pivotal plate 18 which allows the coin box 2 to be pulled outwardly. At this moment, the user still has to input a code by means of, e.g., a key pad (not shown), and if the code is identified to be correct, the electromagnetic valve 27 is activated to move downwardly to open the movable door plate 23, thereby allowing removal of the coins in the coin box 2. In this embodiment, the code is inputted by a key pad, and a connector 281 (FIG. 1) is electrically connected to a code identifying means (not shown) and connected to a control plate 28. If the inputted code is correct, the control plate 28 will send a signal to activate the electromagnetic valve 27 to urge the door plate 23 to move, thereby revealing the upper opening 20 again.

By such an arrangement, unauthorized access to the coin box 2 is prevented as the movable plate 23 cannot be opened unless a proper code is inputted. In addition, the quantity of the coins which have passed through the access 13 can be calculated such that the worker in charge of the coin box 2 cannot steal the money.

Although the invention has been explained in relation to its preferred embodiment, it is to be understood that many other possible modifications and variations can be made without departing from the spirit and scope of the invention as hereinafter claimed.

What is claimed is:

1. A coin box assembly, comprising:

a coin box comprising an upper opening defined in an upper side thereof and an upper lid assembly, the upper lid assembly including a fixed plate, a movable door plate attached to the fixed plate, and means for biasing the door plate toward the fixed plate such that the upper opening of the coin box is in a normally open position for receiving coins, the coin box further including a pair of first horizontal grooves respectively defined in two lateral inner walls thereof, the door plate including two lateral edges respectively, slidably received in the first horizontal grooves, the movable plate further including an actuating block mounted to a first end of an upper side thereof and a stop mounted to a second end of the underside thereof, the coin box further including a second horizontal groove defined in each of two lateral outer walls thereof, main housing for receiving the coin box, the main housing comprising a first end adjacent to the fixed plate and a second end distal to the fixed plate, an opening being defined in the first end of the main housing through which the coin box is passable, the main housing further comprising a bottom plate, a pair of rails being mounted in the second end of the main housing at a level higher than the bottom plate of the main housing for respectively engaging with the second horizontal grooves of the coin box, an inclined plate being provided in the main housing in front of the rails for lifting the coin box to engage with the rails so as to guide the coin box to a position completely received in the main housing, the main housing further including a coin access defined in an upper plate thereof and in alignment with the upper opening of the coin box when the coin box is completely received in the main housing, a pivotal plate being pivotally mounted below the upper plate of the main housing, the pivotal plate being only rotatable in a direction which allows insertion of the coin box and to prevent removal of the coin box from the main housing when the actuating block of the coin box contacts with the pivotal plate, a locking means for securing the coin box in position when the coin box is completely received in the main housing, and an electromagnetic valve mounted to the coin box, wherein when removing the coin box from the main housing the stop of the movable door plate is moved across the electromagnetic valve such that the door plate is moved away from the fixed plate and thus blocks the upper opening of the coin box, and wherein the stop of the door plate is securely engaged with the electromagnetic valve after the stop has been moved across the electromagnetic valve to still block the upper opening of the coin box.

2. The coin box assembly according to claim 1, further comprising a means for activating the electromagnetic valve to disengage from the stop of the door plate so as to urge the door plate to move toward the fixed plate, thereby revealing the upper opening of the main housing again.

* * * * *